US009170052B2

(12) United States Patent
Nakamura et al.

(10) Patent No.: US 9,170,052 B2
(45) Date of Patent: Oct. 27, 2015

(54) LOWER VESSEL OF RH DEGASSER

(75) Inventors: Yoshiyuki Nakamura, Hiroshima (JP); Hisaki Kato, Tokyo (JP); Shinya Yoshimitsu, Hiroshima (JP); Hiroharu Ido, Tokyo (JP); Hiroshi Nomura, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 240 days.

(21) Appl. No.: 13/824,733

(22) PCT Filed: Oct. 7, 2011

(86) PCT No.: PCT/JP2011/073761

§ 371 (c)(1),
(2), (4) Date: Sep. 16, 2013

(87) PCT Pub. No.: WO2012/050219

PCT Pub. Date: Apr. 19, 2012

(65) Prior Publication Data

US 2014/0015175 A1 Jan. 16, 2014

(30) Foreign Application Priority Data

Oct. 13, 2010 (JP) ..... 2010-230363

(51) Int. Cl.

| | |
|---|---|
| ***C21C 7/10*** | (2006.01) |
| ***F27D 1/04*** | (2006.01) |
| ***C21C 1/06*** | (2006.01) |

(52) U.S. Cl.

CPC ... *F27D 1/04* (2013.01); *C21C 1/06* (2013.01); *C21C 7/10* (2013.01); *F27D 1/045* (2013.01)

(58) Field of Classification Search

CPC ..... F27D 1/04; F27D 2001/047

USPC ..... 266/208, 280, 283, 286

See application file for complete search history.

(56) References Cited

U.S. PATENT DOCUMENTS

| | | | | |
|---|---|---|---|---|
| 3,429,487 | A * | 2/1969 | Miller et al. | 222/591 |
| 5,332,201 | A | 7/1994 | Poschl | |
| 5,911,946 | A * | 6/1999 | Aichinger et al. | 266/209 |
| 2014/0015175 | A1 * | 1/2014 | Nakamura et al. | 266/200 |

FOREIGN PATENT DOCUMENTS

| | | |
|---|---|---|
| JP | U-60-040454 | 3/1985 |
| JP | U-64-030350 | 2/1989 |

(Continued)

OTHER PUBLICATIONS

International Search Report issued in International Application No. PCT/JP2011/073761 dated Jan. 24, 2012.

*Primary Examiner* — Scott Kastler
(74) *Attorney, Agent, or Firm* — Oliff PLC

(57) ABSTRACT

A bottom part refractory includes a center part refractory, an arrangement refractory which is arranged contiguously with the center part refractory, and a connection refractory which is arranged at a position where at least a portion of the connection refractory overlaps with a vertically downward projection view of a side wall refractory. The connection refractory which is contiguously arranged with the arrangement refractory is constituted of two or more force transmission refractories arranged in the direction toward the arrangement refractory from the side-wall refractory. Opposedly facing surfaces between the force transmission refractories at least at a position among the force transmission refractories are inclined such that upper portions of the opposedly facing surfaces are positioned on a more inner side of a bottom portion than lower portions of the opposedly facing surfaces are positioned.

18 Claims, 5 Drawing Sheets

(56) References Cited

FOREIGN PATENT DOCUMENTS

| | | |
|---|---|---|
| JP | U-03-009249 | 1/1991 |
| JP | A-06-074662 | 3/1994 |
| JP | A-09-263819 | 10/1997 |
| JP | A-11-173764 | 7/1999 |
| JP | A-2000-160231 | 6/2000 |
| JP | A-2004-107742 | 4/2004 |

* cited by examiner

Related Art (a)

LOWER VESSEL OF RH DEGASSER

The present invention relates to a lower vessel of an RH degasser which is featured by the refractory lining structure.

BACKGROUND

As the lining structure of the lower vessel of the RH degasser, there has been known the structure described in patent document 1, for example. According to the description of the patent document 1, as shown in FIG. 7, there is disclosed the structure where a refractory 61 which constitutes a center block sandwiched between two circulating flow tubes 60 has the downwardly expanding reverse jack arch structure, and constitutes a part of tuyeres of the circulating flow tubes.

By adopting the above-mentioned structure, floating of the refractory 61 which constitutes the center block can be suppressed.

Further, in patent document 2, as shown in FIG. 6, the following structure is described. Ina lining of a bottom part of a vacuum vessel 50 provided with circulating flow holes 51 at two positions respectively, a row of lining bricks which are positioned between the circulating flow holes 51 are stacked in one direction in an inclined manner along a center line of the bottom part, a frontwardly tapered taper which extends toward an upper side of the circulating flow hole is formed on an upper outer peripheral surface 53 of a circulating flow tube brick 52, and side surfaces of a brick 54 which is positioned between the circulating flow holes 51 are widened upward with an angle which matches the taper of the upper peripheral surface of the circulating flow tube brick 52.

RELATED PRIOR ART DOCUMENTS

[Patent Document 1] JP-A-2004-107742
[Patent Document 2] JP-A-2000-160231

BRIEF SUMMARY

In patent document 1, when the refractory is thermally expanded, a downward force is transmitted to the refractory 61 which constitutes the center block from a bottom part refractory 62*a* arranged adjacent to the refractory 61 so that floating of the refractory 61 which constitutes the center block is prevented. In this case, however, an upward force is transmitted to the bottom part refractory 62*a* from the refractory 61 which constitutes the center block. Further, a buoyancy acts on the bottom part refractory due to the difference in specific gravity between molten steel and the refractory.

Accordingly, in the above-mentioned conventional structure, there exists a possibility that the bottom part refractory 62*a* is displaced upward relative to the refractory which constitutes the center block. Further, the conventional structure has a drawback that when the bottom part refractory 62*a* is displaced upward, there exists a possibility that the refractory which constitutes the center block is also floated.

Due to the structure described in patent document 2, the floating of the circulating flow tube brick 52 may be prevented. However, in patent document 2, disclosed is the structure where bottom part bricks which are positioned below wall bricks 55 are simply pushed by a vertical load from the wall bricks 55 by pressing. Here, it is necessary to constrain a brick which constitutes a center part by a force which is generated in the lateral direction due to the thermal expansion of the bottom part bricks. However, a monolithic refractory or the like is present on an outer peripheral portion of the bottom part bricks, and the monolithic refractory or the like functions as an expansion absorbing margin. Accordingly, there exists a possibility that an expansion quantity of only the bottom part bricks is insufficient as the above-mentioned constraint force. As a result, only with the inclination of the bottom part bricks described in patent document 2 or only with pressing of the bottom part bricks due to the wall brick structure disclosed in patent document 2, joint opening occurs. Due to the occurrence of the joint opening, there exists a possibility that peeling-off, floating or wear of the bottom part bricks is increased thus lowering durability and increasing a use amount of repair material.

The invention has been made by focusing on the above-mentioned points, and it is an object of the invention to provide a lower vessel of an RH degasser which can more effectively suppress the floating of a refractory which constitutes a center part.

To overcome the above-mentioned drawbacks, a first embodiment of the invention is directed to a lower vessel of an RH degasser where a bottom portion having two circulating flow tubes is lined with a plurality of bottom part refractories, and an inner surface of a side wall is lined with a plurality of side-wall refractories wherein, the plurality of bottom part refractories include center part refractories which are arranged at a center part sandwiched between two circulating flow tubes, arrangement refractories which are contiguously arranged with the center part refractories, and are arranged along an intersecting direction which intersects a line which passes the center part and connects two circulating flow tubes in a horizontal cross-sectional view of the bottom part, connection refractories which are arranged at positions where at least a portion of each of the connection refractories vertically overlaps with a vertically downward projection view of the side-wall refractories, and other bottom part refractories which are arranged at other bottom portion positions, out of the connection refractories, at least the connection refractories which are arranged contiguously with the arrangement refractories are formed of two or more force transmission refractories per row, which are arranged toward the arrangement refractories from the side-wall refractories, and the force transmission refractories are configured such that, to convert a load in the vertical direction from the side wall refractories into a force in the lateral direction, opposedly facing surfaces between the neighboring force transmission refractories at least at a position among the force transmission refractories arranged from the side-wall refractories toward the inside of the bottom are inclined such that upper portions of the opposedly facing surfaces are positioned more inside of the bottom portion than lower portions of the opposedly facing surfaces are positioned.

Next, a second embodiment of the invention is characterized in that, in the first embodiment, opposedly facing surfaces of the arrangement refractories between the arrangement refractories at least at a position among the neighboring arrangement refractories along the intersecting direction which intersects the line which connects two circulating flow tubes are inclined such that upper portions thereof are positioned closer to a center part side than lower portions thereof are positioned.

Next, a third embodiment of the invention is characterized in that, in the first or second embodiment, opposedly facing surfaces of the center part refractories at least at a position among the neighboring center part refractories along the intersecting direction which intersects the line which connects two circulating flow tubes are inclined such that upper portions thereof are positioned closer to a bottom-portion center side than lower portions thereof are positioned.

Next, a fourth embodiment of the invention is characterized in that, in the constitution of any one of the first to third embodiments, the plurality of bottom part refractories include surrounding refractories around the circulating flow tubes which surround the respective circulating flow tubes, and opposedly facing surfaces between the surrounding refractory around circulating flow tubes which is arranged adjacent to the center part refractories and the center part refractories are inclined such that an upper portion of the opposedly facing surface is positioned closer to a circulating flow tube side corresponding to the target surrounding refractories than a lower portion of the opposedly facing surface is positioned.

Next, a fifth embodiment of the invention is directed to a lower vessel of an RH degasser where a bottom portion having two circulating flow tubes is lined with a plurality of bottom part refractories, and an inner surface of a side wall is lined with a plurality of side-wall refractories wherein, the plurality of bottom part refractories include connection refractories which are arranged at a position where at least a portion of each of the connection refractories overlaps with a vertically downward projection view of the side-wall refractories, at least a portion of the connection refractories is constituted of two or more force transmission refractories per row, which are arranged toward an inner side of the bottom portion from the side-wall refractories, and the force transmission refractory is configured such that, to convert a load in the vertical direction from the side wall refractories into a force in the lateral direction, opposedly facing surfaces of the force transmission refractories at least at a position among the force transmission refractories neighboring in the direction of arrangement from the side-wall refractories toward the inside of the bottom are inclined such that upper portions thereof are positioned more inside of the bottom portion than lower portions thereof.

Next, a sixth embodiment of the invention is characterized in that, in any of the first to fifth embodiments, the force transmission refractories which are arranged toward the inner side of the bottom portion from the side-wall refractories are constituted of three or more refractories per row, and opposedly facing surfaces at least at two positions between the force transmission refractories neighboring in the direction of arrangement from the side-wall refractories toward the inside of the bottom are inclined such that upper portions of the opposedly facing surfaces are positioned more inside of the bottom portion than lower portions of the opposedly facing surfaces are positioned, and the inclination of each opposedly facing surface is set such that the inclination becomes closer to a vertical as the force transmission refractories which sandwich the opposedly facing surface are arranged closer to the inner side of the bottom portion.

According to the first or fifth embodiment of the invention, with the provision of the above-mentioned force transmission refractories, a downward force from the side-wall refractories is converted into a force which advances toward the inside of the bottom portion (bottom part), and the force generated by such a conversion is transmitted to the bottom part refractories positioned on an outer peripheral side of the bottom part (bottom part refractories arranged adjacent to the force transmission refractories or the like). The transmission of the force is conducted by way of a joint portion formed between the neighboring refractories.

Due to such a constitution, a force in the horizontal direction which is applied to the bottom part refractories and constrains the bottom part refractories can be increased.

Further, according to the first embodiment of the invention, a force which is transmitted and advances toward the inner side of the bottom portion (bottom part) by way of the above-mentioned force transmission refractories is transmitted to the center part refractories by way of the arrangement refractories. As a result, the center part refractories are constrained by a force which is applied to the center part refractories from both left and right sides in the intersecting direction which intersects the line which connects two circulating flow tubes in a horizontal cross-sectional view of the bottom part and hence, floating of the center part refractories can be suppressed.

Further, according to the second embodiment of the invention, the opposedly facing surfaces at least at one position among the rearrangement refractories neighboring in the intersecting direction which intersects the line which connects two circulating flow tubes in a horizontal cross-sectional view of the bottom part are inclined such that the upper portions thereof are positioned closer to the center part side than the lower portions thereof are positioned. Accordingly, a downward force acts on the arrangement refractories due to a force which is transmitted by way of the above-mentioned force transmission refractories. As a result, the floating of the arrangement refractories can be effectively suppressed.

Further, according to the third embodiment of the invention, the opposedly facing surfaces at least at one position among the center part refractories neighboring in the intersecting direction which intersects the line which connects two circulating flow tubes in a horizontal cross-sectional view of the bottom part are inclined such that the upper portion thereof is positioned closer to the bottom-portion center side than the lower portion thereof is positioned. Accordingly, a downward force acts on the center part refractories due to a force which is transmitted by way of the above-mentioned force transmission refractories. As a result, the floating of the center part refractories can be also effectively suppressed.

Further, according to the fourth embodiment of the invention, the floating of the surrounding refractories around the circulating flow tubes can be suppressed by the center part refractories whose floating is suppressed.

Further, according to the sixth embodiment of the invention, the conversion of the downward force into the lateral force by the force transmission refractories can be carried out at two or more positions and hence, the transmission of force for converting the direction of the force can be carried out more smoothly.

DETAILED DESCRIPTION

Next, an embodiment of the invention is explained in conjunction with drawings.

Figure 1:
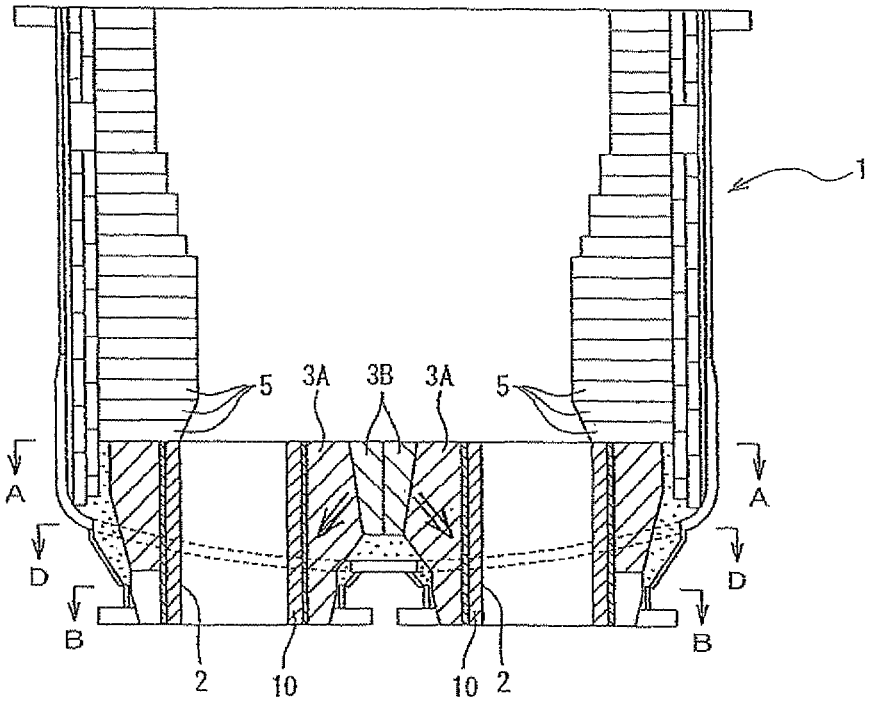
FIG. 1 is a cross-sectional view showing a lower vessel of an RH degasser according to an embodiment of the invention.
Figure 2:
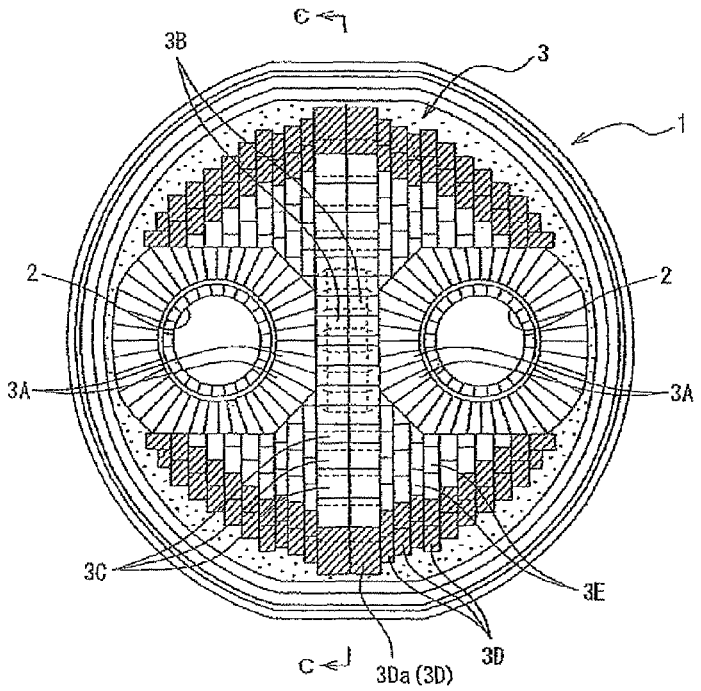
FIG. 2 is a cross-sectional view taken along a line A-A in FIG. 1.
Figure 3:
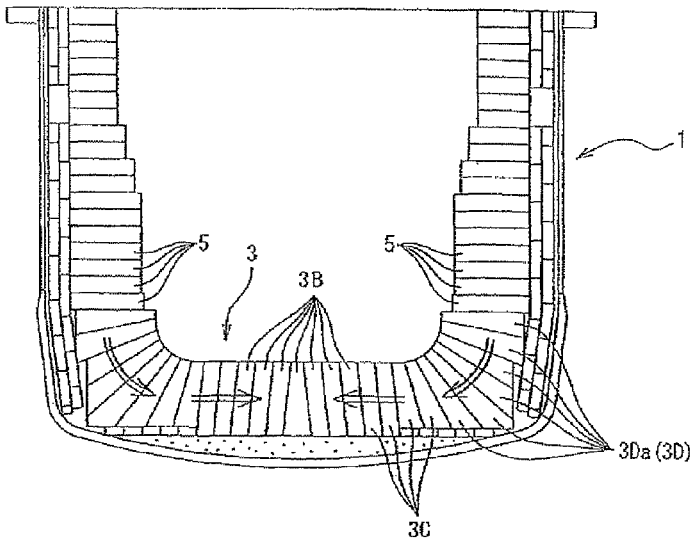
FIG. 3 is a cross-sectional view taken along a line C-C in FIG. 2.

FIG. 1 and FIG. 3 are cross-sectional views showing a lower vessel 1 of an RH degasser of this embodiment. Further, FIG. 2 is a view showing an arrangement example of refractories 3 lined on a bottom portion (bottom part) of the lower vessel 1 of the RH degasser.

(Constitution)

The constitution of the lower vessel 1 of the RH degasser is explained.

The lower vessel 1 of the RH degasser of this embodiment is constituted of a cylindrical side wall portion, and a disc-shaped bottom part (bottom portion) having circulating flow tubes 2 which are passages for molten steel. Symbol 10 indicates a circulating-flow-tube sleeve brick.

Two circulating flow tubes 2 are arranged on the bottom part in right-and-left symmetry, and the bottom part is lined with a plurality of bottom part refractories 3. Although refractory bricks may be exemplified as refractories, any refractories are applicable provided that the refractories are shaped refractories.

In this embodiment, circulating-flow-tube sleeve bricks 10 are arranged as stated above, and a castable refractory is filled into a space between bottom part refractories 3 (namely, surrounding refractories 3A around the circulating flow tubes to be hereinafter described) and circulating-flow-tube sleeve bricks 10. The structure of the circulating flow tube 2 is not restricted to this embodiment.

With respect to a material of the above-mentioned refractories, a magnesia-carbon brick (MgO—C), a magnesia-chrome brick (MgO—$Cr_2O_3$), a combination of the magnesia-carbon brick and the magnesia-chrome brick, or other materials (a magnesia-dolomite brick (MgO—CaO), a magnesia-dolomite-carbon (MgO—CaO—C), an alumina-magnesia-precast block) is used in a single form or a plurality of these materials are used in combination.

The above-mentioned plurality of bottom part refractories 3 are constituted of surrounding refractories 3A around the circulating flow tubes, center part refractories 3B, arrangement refractories 3C, connection refractories 3D, and other bottom part refractories 3E which are arranged on other bottom-portion positions.

The surrounding refractories 3A around the circulating flow tubes are refractories which surround the peripheries of the respective circulating flow tubes 2 and are arranged along the circumferential direction of the target circulating flow tube 2. The respective surrounding refractories around the circulating flow tubes 3A are arranged in a radially extending manner from the circulating flow tube 2.

The center part refractories 3B are refractories which are arranged on a center part sandwiched between two circulating flow tubes 2. In this embodiment, the explanation is made by taking a case where the surrounding refractories 3A around the circulating flow tubes are interposed between the center part refractories 3B and the circulating flow tubes 2 as an example. Here, the surrounding refractory 3A around the circulating flow tube arranged between the center part refractory 3B and the circulating flow tube 2 and the center part refractories 3B may be formed as an integral-body refractory. The center part refractories 3B are constituted of a plurality of refractories arranged along the direction which intersects a line connecting two circulating flow tubes 2 (in this embodiment, along the direction orthogonal to the line) in a horizontal cross-sectional view of the bottom part.

The above-mentioned arrangement refractories 3C are refractories which are contiguously arranged with the center part refractories 3B and are arranged along the same direction as the center part refractories 3B.

The above-mentioned connection refractories 3D are refractories which are arranged along an outer peripheral portion of the bottom part (a hatched portion in FIG. 2). Each connection refractory 3D is arranged at a position where at least a portion of the connection refractory 3D overlaps with a vertically downward projection view of the side-wall refractory 5.

Other bottom part refractories 3E which are arranged at other bottom-portion positions are, in this embodiment, arranged along the direction parallel to the arrangement direction of the arrangement refractories 3C.

Further, an inner surface of a side wall is lined with a plurality of side-wall refractories 5. The side-wall refractories 5 are arranged on the connection refractories 3D in a stacked manner.

Here, with respect to the construction of the refractories, the bottom part refractories 3 are constructed on the bottom part and, thereafter, the side-wall refractories 5 are constructed. Further, monolithic refractory such as joint mortar is filled in joint portions between the refractories.

In this embodiment, out of the above-mentioned connection refractories 3D, the connection refractory which is contiguously formed with the above-mentioned arrangement refractory 3C is, as shown in FIG. 3, constituted of a plurality of force transmission refractories 3Da such that a load in the vertical direction from the side-wall refractories 5 can be converted into a force in the lateral direction. FIG. 3 exemplifies a case where the force transmission refractory 3Da is constituted of six force transmission refractories 3Da per row from the side-wall refractory toward the inside of the bottom portion.

The above-mentioned plurality of force transmission refractories 3Da are arranged from the side-wall refractories 5 to the arrangement refractories 3C and, at the same time, opposedly facing surfaces between the neighboring force transmission refractories 3Da in the arrangement direction are inclined such that upper portions of the opposedly facing surfaces are positioned more inside of the bottom portions than lower portions of the opposedly facing surfaces are positioned. The opposedly facing surface means a surface of each refractory facing the neighboring refractory. Accordingly, as shown in FIG. 3, each force transmission refractory 3Da of this embodiment has a wedge shape where a thickness is gradually decreased toward an inner side of the lower vessel 1 as viewed in a side view.

The inclination of the opposedly facing surface of each force transmission refractory 3Da is set such that the inclination becomes closer to a vertical as the force transmission refractories 3Da between which the opposedly facing surface is formed are arranged closer to the inner side of the bottom portion. That is, the inclination is set such that the inclination is gradually increased in the direction toward an arrangement refractories 3C side from a side-wall refractories 5 side.

In this embodiment, also with respect to the above-mentioned arrangement refractories 3C, an opposedly facing surfaces between the neighboring arrangement refractories 3C in the arrangement direction are inclined such that upper portions of the opposedly facing surfaces are positioned closer to the center part side than lower portions of the opposedly facing surfaces are positioned. Here, it is not necessary to incline all of the opposedly facing surfaces between neighboring arrangement refractories 3C in the arrangement direction.

In the same manner, also with respect to the center part refractories 3B, opposedly facing surfaces between the neighboring center part refractories 3B in the arrangement direction are inclined such that upper portions of the opposedly facing surfaces are positioned closer to the center of the bottom portion than lower portions of the opposedly facing surfaces are positioned. Here, as shown in FIG. 3, the center part refractory 3B at the center has a wedge shape where a thickness is gradually increased downward as viewed in a side view orthogonal to the arrangement direction of the center part refractories 3B.

Further, a surface of the center part refractory 3B which faces a side orthogonal to the arrangement direction of the center part refractories 3B (a surface of the center part refractory 3B on a circulating flow tube 2 side) is, as shown in FIG. 1, inclined such that an upper portion of the surface is arranged closer to the circulating flow tube 2 corresponding to the target surrounding refractory 3A than a lower portion of the surface is arranged. In conformity with such inclination of the surface, an opposedly-facing surface of the surrounding refractory 3A around the circulating flow tube arranged adjacent to the center part refractory 3B is also inclined.

(Manner of Operation)

A downward force is applied to the connection refractories 3D from the side-wall refractories 5. Particularly, when the side-wall refractories 5 are thermally expanded, the above-mentioned downward force becomes large. In this embodiment, among the above-mentioned connection refractories 3D, by constituting the connection refractory 3D at a position where the connection refractory 3D is contiguously formed with the arrangement refractory 3C using the plurality of force transmission refractories 3Da as described above, a downward force from the side-wall refractories 5 can be converted into a force in the horizontal direction which advances toward an inner side of the bottom portion, and the force in the horizontal direction can be transmitted to the arrangement refractories 3C (see FIG. 3).

Here, the transmission of the force between the respective refractories is conducted by way of the joint portion, wherein the transmission of force is conducted between the neighboring refractories toward the direction approximately orthogonal to surfaces (opposedly-facing surfaces) of the respective refractories which form the joint portion.

Further, in this embodiment, by gradually increasing the inclination of the opposedly-facing surfaces between the plurality of arranged force transmission refractories 3Da, the transmission direction of force is converted in a stepwise manner and hence, the downward force can be further smoothly converted into the lateral force which advances to the inside of the bottom portion.

The force in the horizontal direction which is transmitted to the arrangement refractory 3C which is positioned on an outer peripheral side among the arrangement refractories 3C is sequentially transmitted to the arrangement refractories 3C on an inner peripheral side from the arrangement refractories 3C on the outer peripheral side. Here, by also inclining the opposedly facing surface between the arrangement refractories 3C, a downward component force is generated in the arrangement refractories 3C to which the horizontal force is transmitted and hence, it is possible to suppress the floating of the arrangement refractory 3C more surely. That is, the movement of the arrangement refractory 3C is constrained by the force which advances toward the inside in the horizontal direction and, at the same time, the floating of the arrangement refractory 3C can be suppressed more surely by the above-mentioned downward component force.

The force in the horizontal direction which is transmitted to the inner peripheral side from the outer peripheral side among the plurality of arrangement refractories 3C is, subsequently, transmitted to the center part refractories 3B. The displacement of the center part refractories 3B is constrained by the force from the lateral direction. Further, by also inclining opposedly facing surfaces between the neighboring center part refractories 3B, a downward component force is loaded to each center part refractory 3B and hence, floating of each center part refractories 3B can be suppressed more surely.

Further, to consider a case where the center part refractories 3B and the surrounding refractories 3A around the circulating flow tubes are thermally expanded due to a thermal load, since the opposedly facing surfaces of the center part refractory 3B and the surrounding refractory 3A around the circulating flow tube are inclined as described previously, when a force is transmitted mutually between the center part refractory 3B and the surrounding refractory 3A around the circulating flow tube, a downward force is transmitted toward the surrounding refractory 3A around the circulating flow tubes from the center part refractory 3B whereby the floating of the surrounding refractories 3A around the circulating flow tubes can be suppressed. Here, the inclination is preferably in a range between 65 degrees or more and less than 90 degrees from the horizontal direction.

As described part above, according to this embodiment, in addition to the force in the horizontal direction generated due to the thermal expansion of the bottom part refractories 3, the downward force from the side-wall refractories 5 is converted into the force in the horizontal direction and the force is transmitted to the bottom part refractories 3 so that the force in the horizontal direction which constrains the respective bottom part refractories 3 can be increased. Here, the downward force from the side-wall refractories 5 is increased when the side-wall refractories 5 are thermally expanded and hence, when the force in the horizontal direction is necessary, the above-mentioned force in the horizontal direction can be further increased. Accordingly, the floating of the bottom part refractories 3 can be suppressed.

That is, only with an expansion force in the horizontal direction generated by the bottom part refractories 3, a bottom part floating preventing effect is small and hence, it has been necessary to use the lower vessel of the RH degasser in a state where the refractories having a large thickness still remains. However, by adopting the structure where bottom part refractories 3 are arranged contiguously with the side wall, a part of an expansion force in the height direction of the side wall portion is converted into a force in the horizontal direction so that the force in the horizontal direction applied to the bottom part can be increased thus constraining the bottom part refractories 3 more surely.

Further, by providing the above-mentioned inclination to the opposedly facing surfaces of the arrangement refractory 3C and the center part refractories 3B, a downward force is applied to the respective refractories and hence, the floating of the refractories can be further suppressed.

Further, by converting the force transmission direction in a stepwise manner using a plurality of force transmission refractories 3Da, the downward force from the side-wall refractories 5 can be converted into the force in the horizontal direction more surely.

Figure 4:
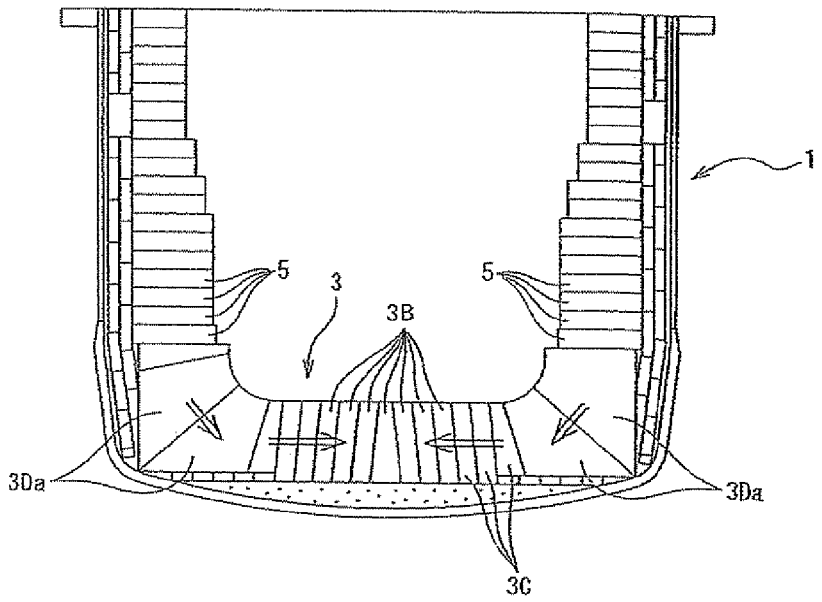
FIG. 4 is a view showing another example of force transmission refractories.

However, the plurality of force transmission refractories 3Da may be, as shown in FIG. 4, constituted of two force transmission refractories 3Da per row. In this case, it is sufficient to incline opposedly facing surfaces between two force transmission refractories 3Da. Here, inclination surface of the opposedly facing surfaces may be set to inclination of 40 to 60 degrees with respect to a horizontal plane, for example.

Here, in the above-mentioned embodiment, the explanation has been made with respect to the case where only the connection refractory 3D which is contiguously formed with the arrangement refractory 3C is constituted of the plurality of force transmission refractories 3Da. However, other connection refractories 3D may be constituted of the plurality of force transmission refractories 3Da having the above-mentioned structure. In this case, it is possible to impart a force which constrains the surrounding refractory around the circulating flow tube also through other bottom part refractories 3E. In this case, also with respect to other bottom part refractories 3E, it is also preferable to incline opposedly facing surfaces of the neighboring bottom part refractories 3 such that an upper portion of the opposedly facing surface is closer to the circulating flow tube 2 than a lower portion of the opposedly facing surface is.

Further, in the embodiment shown in FIG. 3, the number of force transmission refractories 3Da is set to 6, the inclination is increased by 10.6 degrees from the horizontal direction for every force transmission refractory 3Da in the direction toward the arrangement refractories from the side wall, and the inclination of the opposedly facing surface of the force transmission refractory 3Da with the arrangement refractory is set to 63.6 degrees. The reason of the inclination of the opposedly facing surfaces between the force transmission refractory 3Da and the arrangement refractory 3C is to apply a downward component force to the arrangement refractory, and the inclination is preferably less than 90 degrees, and more preferably 85 degrees or less. However, when the inclination of the opposedly facing surfaces between the force transmission refractory and the arrangement refractory is set to less than 50 degrees, there is a possibility that a transmission force in the horizontal direction becomes weak. By taking such a possibility into consideration, the inclination of the opposedly facing surface is preferably set to 50 degrees or more and, in the embodiment of the invention shown in FIG. 3, it is set to 63.6 degrees. Similarly, when the opposedly facing surfaces between the force transmission refractory 3Da and other bottom part refractory are inclined, the inclination is preferably set to 50 degrees or more and less than 90 degrees, more preferably 85 degrees or less. Also, when the opposedly facing surface of the arrangement refractory 3C, the center part refractory 3B, and other bottom part refractory 3E in the arrangement direction are inclined, the inclination is preferably set to 60 degrees or more and less than 90 degrees from the horizontal line such that a component force in the vertical direction does not become excessive. However, the arrangement refractory or other bottom part refractory is positioned on an outer peripheral portion and the opposedly surface thereof facing the force transmission refractory is inclined at 50 degrees or more to less than 60 degrees, the opposedly surface in the arrangement direction may be inclined in a range of 50 degrees or more because a downward component force applied to these refractories is large. Also, it is preferred that a downward component force is appropriately applied to the arrangement refractory 3C, the center part refractory 3B, and other bottom part refractory 3E by setting the thickness of the refractory in the arrangement direction such that the lower part thereof is thicker than the upper part, as shown in FIG. 3.

It is confirmed that, with the provision of such force transmission refractories 3Da, an average damage rate of the bottom part refractory 3 is delayed such that the average damage rate is approximately halved.

To assume that the number of the above-mentioned force transmission refractories 3Da is set within a range of 3 to 12 and the opposedly surfaces between the force transmission refractory and the arrangement refractory is set to 63.3 degrees as in the example shown in FIG. 3, when the number of force transmission refractories 3Da is 3, the inclination angle is set with the increase of the inclination angle by 21.2 degrees, and when the number of force transmission refractories 3Da is 12, the inclination angle is set with the increase of the inclination angle by 5.3 degrees.

Further, it is confirmed that when the number of force transmission refractories 3Da to be used is three or more, by setting the inclined opposedly facing surface such that the opposedly facing surface having the inclination which falls within a range of 30 to 70 degrees relative to the horizontal surface exists, a downward force from the side wall refractories 5 can be converted into a force in the horizontal direction.

Figure 5:
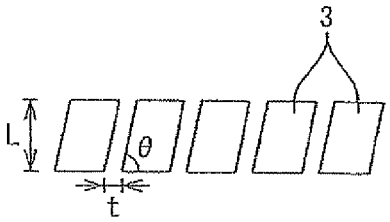
FIG. 5 is a view for explaining the inclination of refractories.
Figure 6:
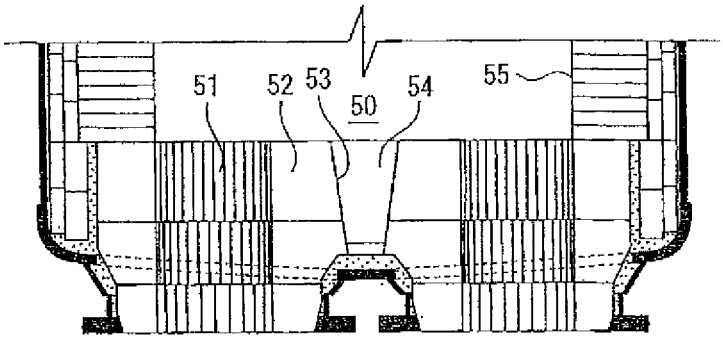
FIG. 6 is a view showing the structure of a conventional lower vessel of an RH degasser.
Figure 7:
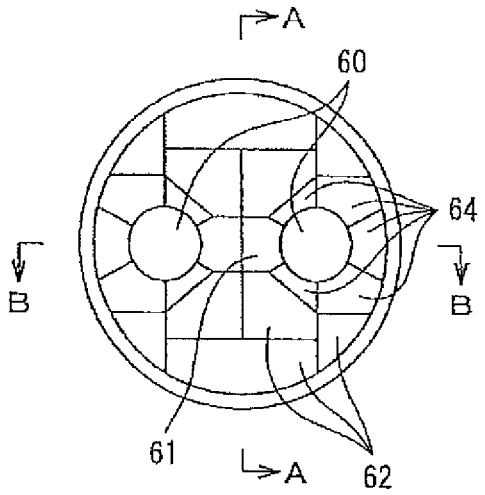
FIG. 7 Related Art
FIG. 7 is a view showing the structure of a conventional lower vessel of an RH degasser.
Figure 7:
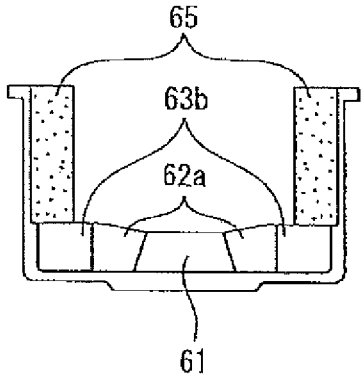
FIG. 7 Related Art
Figure 7:
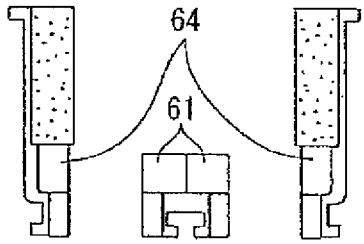
FIG. 7 Related Art

To prevent the floating of the bottom part refractories 3 even when the bottom part refractories 3 excluding the force transmission refractories 3Da are worn, the inclined refractory preferably satisfies the following formula based on FIG. 5.

$$L > t \cdot \tan\theta$$

wherein

L: brick length in vertical direction t: thickness of joint in the horizontal direction θ: inclination angle of opposed facing surface of refractory In the embodiments shown in FIGS. 1 and 2, the center part refractories 3B, the arrangement refractories 3C and the force transmission refractories 3Da are explained for the case where they are arranged in two rows, the number of rows are not limited to 2, and a large-sized refractory may be arranged in one row, or the refractories are arranged in three or more rows.

Example 1

Experiments were carried out with respect to the advantageous effects of the above-mentioned embodiment.

Example

In the example, in accordance with the above-mentioned embodiment, center part refractories having the above-mentioned inclination structure were provided, and the structure where a plurality of force transmission refractories 3Da are inclined so as to convert a load from the side wall refractories 5 into a force in the lateral direction (toward the above-mentioned arrangement refractories 3C) (the integral structure formed of the side wall refractories and the bottom part refractories) was adopted. Specifically, the adopted structures were the following two configurations, that is:

the case where the number of the force transmission refractories 3Da is set to 2, the center part refractory 3B is inclined at 85 degrees and the arrangement refractory 3C is inclined at 74.2 to 85 degrees (FIG. 4), the case where the number of the force transmission refractories 3Da is set to 6, the center part refractory 3B is inclined at 85 degrees and the arrangement refractory 3C is inclined at 63.6 to 85 degrees (FIG. 3), and the opposedly surface between the refractories 3B and 3A is inclined at 85 degrees in each case.

Further, the following two structures were adopted as comparison examples.

Comparison Example 1

The inclination structure was not applied to the center part refractories, and the structure where the side wall refractories are arranged vertically and all of the bottom part refractories are arranged horizontally was adopted. That is, no force transmission refractory was arranged.

Comparison Example 2

The inclination structure was applied to the center part refractories, and the structure where the side wall refractories are arranged vertically and the rest of the bottom part refractories are arranged horizontally (that is, no force transmission refractory is arranged) was adopted.

Then, the structure of the above-mentioned example and the structure of the above-mentioned respective comparison examples were applied to an actual machine respectively. As the result of the experiment, it is confirmed that a wear rate of a bottom part is decreased by approximately 50% in each of the examples compared to a lower vessel of the comparison example 1.

Further, in the comparison example 2, no noticeable change was found in the wear state compared to the comparison example 1.

According to the invention, it becomes possible to prevent the refractory in the lower vessel of the RH degasser from floating in an efficient manner.

EXPLANATION OF SYMBOLS

1: lower vessel of RH degasser
2: circulating flow tube
3: bottom part refractory
3A: surrounding refractory around circulating flow tube
3B: center part refractory
3C: arrangement refractory
3D: connection refractory
3Da: force transmission refractory
3E: other bottom part refractory
5: side-wall refractory

The invention claimed is:

1. A lower vessel of an RH degasser where a bottom portion having two circulating flow tubes is lined with a plurality of bottom part refractories, and an inner surface of a side wall is lined with a plurality of side-wall refectories, wherein:

the plurality of bottom part refractories include center part refractories which are arranged at a center part sandwiched between two circulating flow tubes, arrangement refractories which are contiguously arranged with the center part refractories, and are arranged along an intersecting direction which intersects a line which passes the center part and connects two circulating flow tubes in a horizontal cross-sectional view of the bottom part, connection refractories which are arranged at positions where at least a portion of each of the connection refractories overlaps with a vertically downward projection view of the side-wall refractories, and other bottom part refractories which are arranged at other bottom portion positions, of the connection refractories, at least the connection refractories which are arranged contiguously with the arrangement refractories are formed of two or more force transmission refractories per row, which are arranged toward the arrangement refractories from the side-wall refractories, and the force transmission refractories are configured such that, to convert a load in the vertical direction from the side wall refractories into a force in the lateral direction, opposedly facing surfaces of the force transmission refractories at least at a position between the neighboring force transmission refractories in a row are inclined such that upper portions of the opposedly facing surfaces are positioned more inside of the bottom portion than lower portions of the opposedly facing surfaces are positioned.

2. The lower vessel of the RH degasser according to claim 1, wherein opposedly facing surfaces of the arrangement refractories at least at a position between the neighboring arrangement refractories in a row are inclined such that upper portions thereof are positioned closer to a center part side than lower portions thereof are positioned.

3. The lower vessel of the RH degasser according to claim 1, wherein opposedly facing surfaces of the center part refractories at least at a position between the neighboring center part refractories in a row are inclined such that upper portions thereof are positioned closer to a bottom-portion center side than lower portions thereof are positioned.

4. The lower vessel of the RH degasser according to claim 1, wherein the plurality of bottom part refractories include surrounding refractories around the circulating flow tubes, and opposedly facing surfaces between the surrounding refractories around the circulating flow tubes which is arranged adjacent to the center part refractories and the center part refractories are inclined such that upper portions of the opposedly facing surfaces are positioned closer to a circulating flow tube side corresponding to the surrounding refractories than lower portions of the opposedly facing surfaces are positioned.

5. A lower vessel of an RH degasser where a bottom portion having two circulating flow tubes is lined with a plurality of bottom part refractories, and an inner surface of a side wall is lined with a plurality of side-wall refractories, wherein:

the plurality of bottom part refractories include connection refractories which are arranged at a position where at least a portion of each of the connection refractories overlaps with a vertically downward projection view of the side-wall refractories, at least a portion of the connection refractories is constituted of two or more force transmission refractories per row, which are arranged toward an inner side of the bottom portion from the side-wall refractories, and the force transmission refractory is configured such that opposedly facing surfaces of the force transmission refractories at least at a position between the neighboring force transmission refractories in a row are inclined such that upper portions thereof are positioned more inside of the bottom portion than lower portions thereof to convert a load in the vertical direction from the side wall refractories into a force in the lateral direction.

6. The lower vessel of the RH degasser according to claim 1, wherein the force transmission refractories which are arranged toward the inner side of the bottom portion from the side-wall refractories are constituted of three or more refractories per row, and opposedly facing surfaces of force transmission refractories at least at two positions between the neighboring force transmission refractories in a row are inclined such that upper portions of the opposedly facing surfaces are positioned more inside of the bottom portion than lower portions of the opposedly facing surfaces are positioned, and the inclination of each opposedly facing surface is set such that the inclination becomes closer to a vertical as the force transmission refractories which sandwich the opposedly facing surface are arranged closer to the inner side of the bottom portion.

7. The lower vessel of the RH degasser according to claim 2, wherein opposedly facing surfaces of the center part refractories at least at a position between the neighboring center part refractories in a row are inclined such that upper portions thereof are positioned closer to a bottom-portion center side than lower portions thereof are positioned.

8. The lower vessel of the RH degasser according to claim 2, wherein the plurality of bottom part refractories include surrounding refractories around the circulating flow tubes, and opposedly facing surfaces between the surrounding refractories around the circulating flow tubes which is arranged adjacent to the center part refractories and the center part refractories are inclined such that upper portions of the opposedly facing surfaces are positioned closer to a circulating flow tube side corresponding to the surrounding refractories than lower portions of the opposedly facing surfaces are positioned.

9. The lower vessel of the RH degasser according to claim 3, wherein the plurality of bottom part refractories include surrounding refractories around the circulating flow tubes, and opposedly facing surfaces between the surrounding refractories around the circulating flow tubes which is arranged adjacent to the center part refractories and the center part refractories are inclined such that upper portions of the opposedly facing surfaces are positioned closer to a circulating flow tube side corresponding to the surrounding refractories than lower portions of the opposedly facing surfaces are positioned.

10. The lower vessel of the RH degasser according to claim 7, wherein the plurality of bottom part refractories include surrounding refractories around the circulating flow tubes, and opposedly facing surfaces between the surrounding refractories around the circulating flow tubes which is arranged adjacent to the center part refractories and the center part refractories are inclined such that upper portions of the opposedly facing surfaces are positioned closer to a circulating flow tube side corresponding to the surrounding refractories than lower portions of the opposedly facing surfaces are positioned.

11. The lower vessel of the RH degasser according to claim 2, wherein the force transmission refractories which are arranged toward the inner side of the bottom portion from the side-wall refractories are constituted of three or more refractories per row, and opposedly facing surfaces of force transmission refractories at least at two positions between the neighboring force transmission refractories in a row are inclined such that upper portions of the opposedly facing surfaces are positioned more inside of the bottom portion than lower portions of the opposedly facing surfaces are positioned, and the inclination of each opposedly facing surface is set such that the inclination becomes closer to a vertical as the force transmission refractories which sandwich the opposedly facing surface are arranged closer to the inner side of the bottom portion.

12. The lower vessel of the RH degasser according to claim 3, wherein the force transmission refractories which are arranged toward the inner side of the bottom portion from the side-wall refractories are constituted of three or more refractories per row, and opposedly facing surfaces of force transmission refractories at least at two positions between the neighboring force transmission refractories in a row are inclined such that upper portions of the opposedly facing surfaces are positioned more inside of the bottom portion than lower portions of the opposedly facing surfaces are positioned, and the inclination of each opposedly facing surface is set such that the inclination becomes closer to a vertical as the force transmission refractories which sandwich the opposedly facing surface are arranged closer to the inner side of the bottom portion.

13. The lower vessel of the RH degasser according to claim 7, wherein the force transmission refractories which are arranged toward the inner side of the bottom portion from the side-wall refractories are constituted of three or more refractories per row, and opposedly facing surfaces of force transmission refractories at least at two positions between the neighboring force transmission refractories in a row are inclined such that upper portions of the opposedly facing surfaces are positioned more inside of the bottom portion than lower portions of the opposedly facing surfaces are positioned, and the inclination of each opposedly facing surface is set such that the inclination becomes closer to a vertical as the force transmission refractories which sandwich the opposedly facing surface are arranged closer to the inner side of the bottom portion.

14. The lower vessel of the RH degasser according to claim 4, wherein the force transmission refractories which are arranged toward the inner side of the bottom portion from the side-wall refractories are constituted of three or more refractories per row, and opposedly facing surfaces of force transmission refractories at least at two positions between the neighboring force transmission refractories in a row are inclined such that upper portions of the opposedly facing surfaces are positioned more inside of the bottom portion than lower portions of the opposedly facing surfaces are positioned, and the inclination of each opposedly facing surface is set such that the inclination becomes closer to a vertical as the force transmission refractories which sandwich the opposedly facing surface are arranged closer to the inner side of the bottom portion.

15. The lower vessel of the RH degasser according to claim 8, wherein the force transmission refractories which are arranged toward the inner side of the bottom portion from the side-wall refractories are constituted of three or more refractories per row, and opposedly facing surfaces of force transmission refractories at least at two positions between the neighboring force transmission refractories in a row are inclined such that upper portions of the opposedly facing surfaces are positioned more inside of the bottom portion than lower portions of the opposedly facing surfaces are positioned, and the inclination of each opposedly facing surface is set such that the inclination becomes closer to a vertical as the force transmission refractories which sandwich the opposedly facing surface are arranged closer to the inner side of the bottom portion.

16. The lower vessel of the RH degasser according to claim 9, wherein the force transmission refractories which are arranged toward the inner side of the bottom portion from the side-wall refractories are constituted of three or more refractories per row, and opposedly facing surfaces of force transmission refractories at least at two positions between the neighboring force transmission refractories in a row are inclined such that upper portions of the opposedly facing surfaces are positioned more inside of the bottom portion than lower portions of the opposedly facing surfaces are positioned, and the inclination of each opposedly facing surface is set such that the inclination becomes closer to a vertical as the force transmission refractories which sandwich the opposedly facing surface are arranged closer to the inner side of the bottom portion.

17. The lower vessel of the RH degasser according to claim 10, wherein the force transmission refractories which are arranged toward the inner side of the bottom portion from the side-wall refractories are constituted of three or more refractories per row, and opposedly facing surfaces of force transmission refractories at least at two positions between the neighboring force transmission refractories in a row are inclined such that upper portions of the opposedly facing surfaces are positioned more inside of the bottom portion than lower portions of the opposedly facing surfaces are positioned, and the inclination of each opposedly facing surface is set such that the inclination becomes closer to a vertical as the force transmission refractories which sandwich the opposedly facing surface are arranged closer to the inner side of the bottom portion.

18. The lower vessel of the RH degasser according to claim 5, wherein the force transmission refractories which are arranged toward the inner side of the bottom portion from the side-wall refractories are constituted of three or more refractories per row, and opposedly facing surfaces of force transmission refractories at least at two positions between the neighboring force transmission refractories in a row are inclined such that upper portions of the opposedly facing surfaces are positioned more inside of the bottom portion than lower portions of the opposedly facing surfaces are positioned, and the inclination of each opposedly facing surface is set such that the inclination becomes closer to a vertical as the force transmission refractories which sandwich the opposedly facing surface are arranged closer to the inner side of the bottom portion.

* * * * *